US006250873B1

(12) United States Patent
Stragier

(10) Patent No.: US 6,250,873 B1
(45) Date of Patent: Jun. 26, 2001

(54) REFUSE COLLECTION VEHICLE

(75) Inventor: Marcel G. Stragier, Scottsdale, AZ (US)

(73) Assignee: The Heil Co., Chattanooga, TN (US)

( * ) Notice: Subject to any disclaimer, the term of this patent is extended or adjusted under 35 U.S.C. 154(b) by 0 days.

(21) Appl. No.: 09/247,489

(22) Filed: Feb. 10, 1999

Related U.S. Application Data

(63) Continuation-in-part of application No. 08/951,998, filed on Oct. 16, 1997, now Pat. No. 6,012,892.

(51) Int. Cl.[7] ..... B65F 3/14

(52) U.S. Cl. ..... 414/511; 414/492; 414/517; 414/525.6

(58) Field of Search ..... 414/492, 509, 414/511, 513, 517, 525.2, 525.6, 813; 100/270, 271

(56) References Cited

U.S. PATENT DOCUMENTS 2,803,357 * 8/1957 Ronfeldt ..... 414/513
2,832,488 * 4/1958 Kamin .
2,934,226 * 4/1960 Dempster et al. .
3,231,107 * 1/1966 Clar .
3,231,111 * 1/1966 Clar .
3,653,271 * 4/1972 Worthington .
4,057,010 * 11/1977 Smith ..... 414/525.6 X
4,221,527 * 9/1980 Morrison ..... 414/525.6 X
4,371,306 * 2/1983 Smith ..... 414/517 X
4,544,320 * 10/1985 Haines ..... 414/511
5,064,332 * 11/1991 Edelhoff et al. ..... 414/408
5,352,084 * 10/1994 Hodgins ..... 414/525.6 X
5,857,822 * 1/1999 Christenson ..... 414/525.6 X

* cited by examiner

*Primary Examiner*—James W. Keenan
(74) *Attorney, Agent, or Firm*—Parsons & Goltry; Robert A. Parsons; Michael W. Goltry

(57) ABSTRACT

A vehicle for collecting refuse comprising a chassis, a body mounted with the chassis for receiving refuse through an opening thereof, a packer assembly for moving refuse into the body through the opening, a gate assembly mounted to serve as a closure for another opening of the body and movable between normally closed and opened positions, and ejecting apparatus including extendible drive means movable between a stored and an ejecting position for additionally and alternately ejecting refuse.

16 Claims, 8 Drawing Sheets

REFUSE COLLECTION VEHICLE

RELATED APPLICATIONS

The present application is a continuation-in-part of U.S. patent application of the same title, bearing Ser. No. 08/951,998, filed Oct. 16, 1997, now U.S. Pat. No. 6,012,892 and assigned to the same assignee.

BACKGROUND OF THE INVENTION

1. Field of the Invention

This invention relates generally to the field of refuse handling apparatus.

More particularly, this invention relates to refuse collection vehicles of a type having a hopper for receiving refuse and a storage body for receiving and storing refuse from the hopper.

In a further and more specific aspect, the present invention concerns novel features for the improved performance and operation of refuse collection vehicles.

2. Prior Art

The collection and removal of refuse, the solid wastes of a community, is a major municipal problem. For example, residential refuse is generated at an average rate of approximately two pounds per day per capita. As accumulated, loose and uncompacted, the refuse has a density generally in the range of 150–300 pounds per cubic yard. For the health and welfare of the community, regular disposal is essential.

Traditionally, residential refuse including garbage, trash and other waste materials was amassed and stored in containers having a ten to thirty gallon capacity. On a regular basis, normally once or twice weekly, the containers were placed by the householder at a designated location for handling by a scheduled collection agency. Frequently designated locations were curbside and alley line. Not uncommonly, the refuse of a single residence, depending upon the number of occupants and the frequency of service, would occupy two or more containers each weighing as much as seventy-five to one hundred pounds.

Considerable effort has been directed by many in the industry of refuse collection toward the development of equipment for the enhancement of the traditional refuse collection method. As a result, current methodology directs that refuse is placed in relatively large containers of uniform dimensions which are handled by automated equipment. The containers may, for example, be of sufficient size to service several households. The collection vehicle is equipped with a self-loading device which lifts and dumps the container. Increased load carrying capacity of the vehicle is achieved through the use of compactor-type bodies.

To further enhance the automated collection of refuse, many refuse collection trucks with storage bodies incorporate a gate assembly mounted with a rearward opening thereof to act as a closure for the rearward opening. However, the accessible rearward opening allows refuse collected within the storage body to be ejected from the rearward opening. To this end, apparatus currently exists for either tilting the storage body upwardly for allowing gravity to move the refuse from the storage body and outwardly through the rearward end for deposit, or ejecting the refuse outwardly through the rearward end. To eject the refuse outwardly through the rearward end of the storage body, innovators have adapted packing mechanisms which operate for not only transferring and packing refuse into the storage body from the hopper, but also for ejecting the refuse outwardly through the rearward end for deposit at suitable waste disposal sites. Although exemplary for intended use, these packing mechanisms are extremely bulky, mechanically inefficient and costly.

It would be highly advantageous, therefore, to remedy the foregoing and other deficiencies inherent in the prior art.

Accordingly, it is an object of the present invention to provide improvements in refuse collection equipment.

Another object of the instant invention is to provide an improved packer and ejection assembly operative for facilitating the incremental movement of a platen into and through a hopper and a storage body for accomplishing not only the compaction of refuse into the storage body but also the ejection of the refuse through a downstream opening of the storage body.

A further object of the invention is the provision of a refuse collection vehicle of the foregoing type which is safer, easier and more economical to operate than conventional prior art refuse collection equipment.

SUMMARY OF THE INVENTION

Briefly, to achieve the desired objects of the instant invention in accordance with a preferred embodiment thereof, provided is a vehicle of a type for collecting refuse. The vehicle is generally comprised of a body and a hopper mounted with the body for receiving refuse. The vehicle further includes a storage body mounted with the body for receiving and storing refuse from the hopper. The storage body is generally comprised of an integral outwardly arcuate top panel, an integral outwardly arcuate bottom panel and integral outwardly arcuate side panels cooperating together to bound a chamber in the rear of the refuse handling vehicle and having forward edges of the panels bounding an upstream opening into the chamber in communication with the hopper for permitting refuse to admit therethrough from the hopper for receipt into the chamber, and rearward edges of the panels bounding a downstream opening into the chamber. A packer and ejection assembly is also provided for transferring refuse from the hopper to the storage chamber along with a gate assembly including a closure element mounted to serve as a closure for the downstream opening and movable from a normal closed position to an open position, and from the open position to the normal closed position.

The packer and ejection assembly of the present invention is generally comprised of a platen mounted for movement along a fixed path for urging refuse from the hopper to the storage body through the upstream opening thereof and drive means for imparting reciprocal motion to the platen alternately between retracted and extended positions in response to actuation of the drive means. The drive means includes a linkage assembly having a linkage element and a pivotally connected extendible element. The linkage element is pivotally attached to the body adjacent one end and the extendible element is pivotally attached to the platen adjacent one end. A hydraulic drive assembly is pivotally attached to the body and the linkage element for movement in reciprocal directions upon actuation of the hydraulic drive assembly such that during movement of the platen through a forward packing stroke the speed of the platen decreases and the force exerted by the platen on the refuse increases throughout the forward packing stroke and during movement of the platen through a rearward packing stroke the speed of the platen increases, the linkage assembly being movable in reciprocal directions for moving the platen in reciprocal directions.

Ejection of the refuse, after collection and storing (including packing or compacting) is accomplished by extension of the extendible element of the linkage assembly during actuation of the hydraulic drive assembly. The extendible element includes, for example, a hydraulic drive assembly, a telescoping hydraulic cylinder, a double acting telescoping hydraulic cylinder, or a set of nested tubes which telescope together and are latched, and which may be unlatched to extend in length and then latched at their longer length and extended by the drive means to push the platen further along its fixed path. The linkage assembly, including the extendible element is constructed so that during movement of the platen through a forward ejection stroke the speed of the platen decreases and the force exerted by the platen on the refuse increases throughout the forward ejection stroke and during movement of the platen through a rearward ejection stroke the speed of the platen increases.

BRIEF DESCRIPTION OF THE DRAWINGS

The foregoing and further and more specific objects and advantages of the instant invention will become readily apparent to those skilled in the art from the following detailed description of preferred embodiments thereof taken in conjunction with the drawings in which.

DETAILED DESCRIPTION OF THE PREFERRED EMBODIMENTS

Figure 1:
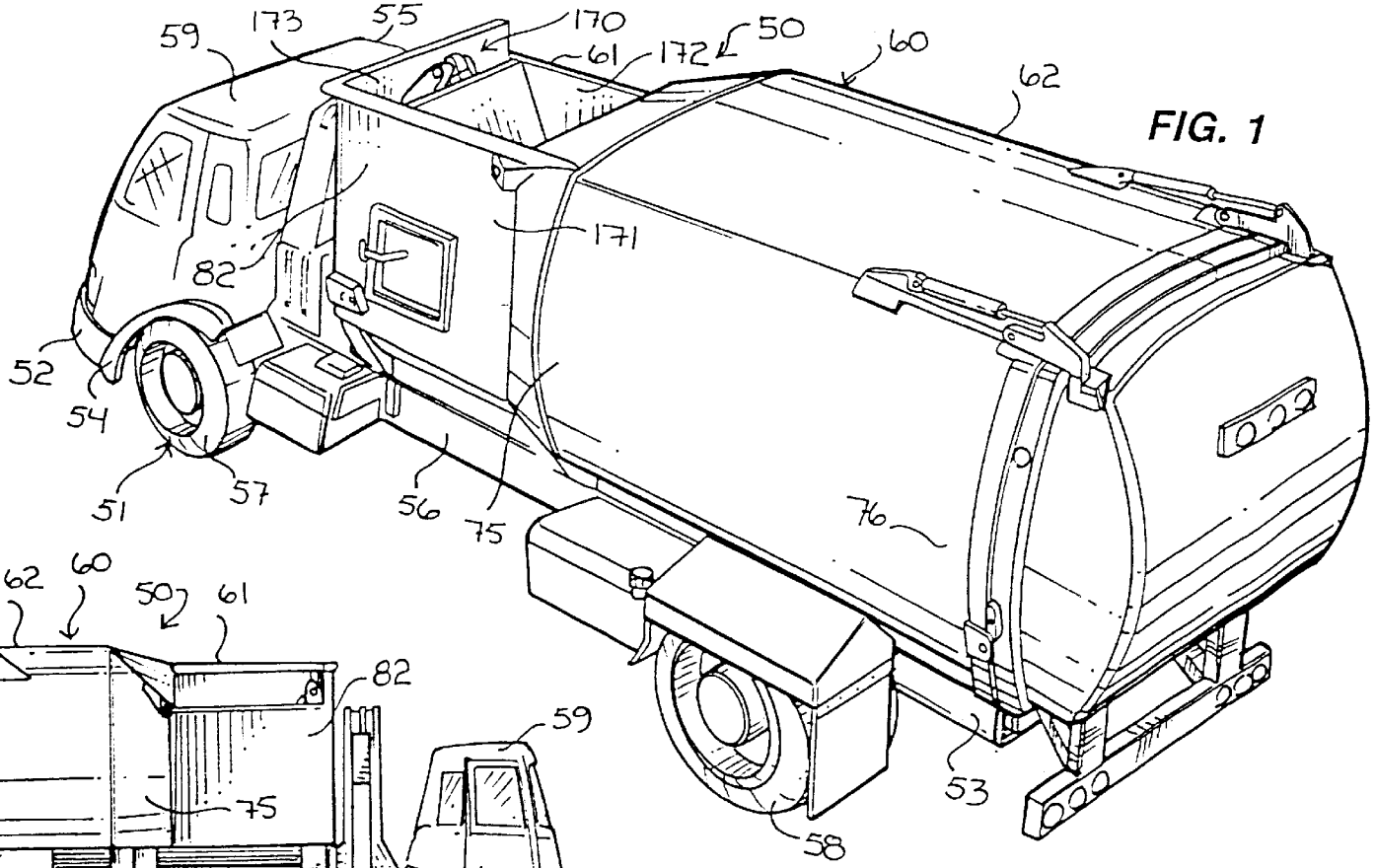
FIG. 1 illustrates an isometric view of a vehicle for collecting refuse, in accordance with a preferred embodiment of the present invention.

Turning now to the drawings, in which like reference characters indicate corresponding elements throughout the several views, attention is first directed to FIG. 1 illustrating a perspective view of a vehicle for collecting refuse generally designated by the reference character 50. Vehicle 50 is of a type generally including a body or chassis 51, which, for the purposes of the ensuing discussion, is considered to have a forward end 52, a rearward end 53, a left or street side 54 and a right or curb side 55. Chassis 51 includes a frame 56 supported above ground level by front wheels 57 and rear wheels 58. In accordance with conventional practice, front wheels 57 are steerable and provide directional control for vehicle 50. Similarly, although not herein specifically shown, rear wheels 58 are caused to rotate in response to a conventional engine, transmission and drive train for propulsion of vehicle 50. A cab 59 carried at forward end 52 of chassis 51 provides for an enclosed drivers compartment including the conventional controls associated with the manipulation of chassis 51 as well as conventional controls associated with the loading and compacting equipment.

The foregoing description of vehicle 50 set forth for the purposes of orientation and reference in connection with the ensuing discussion of preferred embodiments of the instant invention is intended to be generally representative of typical, commercially available vehicles of the foregoing type for collecting refuse. Accordingly, further details not specifically set forth and described will readily occur to those having regard toward the relevant art.

Figure 1A:
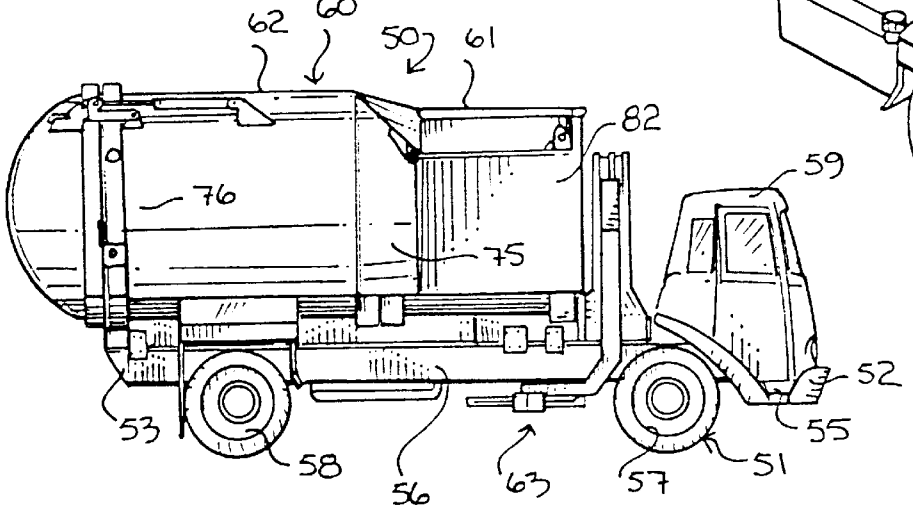
FIG. 1A illustrates a side elevational view of the vehicle illustrated in FIG. 1.

Consistent with the foregoing, vehicle 50 further includes a body 60 carried by frame 56 of chassis 51 rearward of cab 59 and further located upon the rearward portion of frame 56. Body 60 is comprised of a hopper 61 and a storage body 62. Hopper 61, located rearwardly of cab 59 and forwardly of storage body 62, includes means for compacting and stowing refuse within storage body 62, specific details of which will be discussed as the detailed description ensues. In this regard, and with momentary attention directed to FIG. 1A illustrating a curb-side elevational view of vehicle 50, vehicle 50 further includes a container handling apparatus, generally designated by the reference character 63, operative for lifting a refuse container and dumping the contents thereof into hopper 61. Container handling apparatus 63 has been set forth for the purposes of orientation and reference in connection with the ensuing discussion of preferred embodiments of the present invention and is intended to be generally representative of typical, commercially available container handling apparatus commonly found upon vehicles of a type for collecting refuse. Accordingly, further details of container-handling apparatus 63 will not be herein specifically addressed as they will readily occur to the skilled artisan.

With attention directed to FIG. 1 and FIG. 1A body 60, including hopper 61 and storage body 62, preferably constructed of steel or other suitable material having similar structural and functional characteristics, is generally comprised of an integral outwardly arcuate top panel 70, an integral outwardly arcuate bottom panel 71 and integral outwardly arcuate side panels 72 (FIG. 2 and FIG. 4) and 73 cooperating together to bound an inner chamber in the rear of vehicle 50. Storage body 60 is generally considered to have an upstream end 75 directed toward hopper 61 and a downstream end 76 directed toward rearward end 53 of chassis 51. The indication of upstream end 75 and downstream end 76 is set forth for facilitating ease of discussion of preferred embodiments herein and is not intended to be regarded as an inherently limiting feature of ensuing preferred embodiments to be herein discussed. Panels 70, 71, 72 and 73 are substantially coextensive and each include a forward edge, side edges, and a rearward edge. Forward edges of panels 70, 71, 72 and 73 at upstream end 75 of storage body 62 cooperate together to bound an upstream opening into the inner chamber, and rearward edges of panels 70, 71, 72 and 73 at downstream end 76 of storage body 62 cooperate together to bound a downstream opening into the inner chamber.

For the purposes of orientation regarding FIGS. 1 and 1A, hopper 61 is generally intended to have an upstream end 82 directed toward cab 59 and a downstream end 83 directed toward upstream end 75 of storage body 62. Hopper 61 includes a rearward edge at downstream end 83 bounding an opening. The forward edges of storage body 62 are mounted with the rearward edge of hopper 61, such as by conventional welding techniques, in refuse communication for facilitating the transferal of refuse from hopper 61 into the inner chamber from the opening of hopper 61 through the upstream opening of storage body 62. In this regard, the upstream end 82 and downstream end 83 of hopper 61 and the upstream end 75 and downstream end 76 of storage body 62 are intended to denote the general direction of the passage of refuse into and through body 60 of vehicle 50. Refuse placed within hopper 61 is intended to pass from hopper 61 and into storage body 62 in a general direction from upstream end 82 of hopper 61 to downstream end 76 of storage body 62 by virtue of a packer and ejection assembly carried by hopper 61, further details of which will be discussed as the detailed description ensues.

In accordance with the preferred teachings presented herein, the outwardly arcuate configuration of each panel 70, 71, 72 and 73 is set forth not as a matter of design, but rather to advantageously impart unexpected rigidity and strength to each panel 70, 71, 72 and 73. When coupled together to form storage body 62, panels 70, 71, 72 and 73 function together to impart a high degree of strength and corresponding rigidity to the finally assembled storage body 62 without the need for additional reinforcement replete in prior art storage bodies currently in use by conventional refuse collection vehicles of the type herein presented. As a result, and unlike storage body 62, because conventional storage bodies employed with refuse collection vehicles of the variety presented herein employ corrugated panels and panels having vertical and/or horizontal reinforcing elements, they are considerably heavier and bulkier than storage body 62 presented herein and exceedingly difficult and expensive to construct. Because storage body 62 is extremely strong and considerably light as compared to conventional prior art storage bodies of like variety, chamber 74 may accommodate increased payloads within the weight limits for normal highway travel in accordance with state and federal regulations. Panels 70, 71, 72 and 73 may each be further constructed of selected and desired thickness for increasing the wear of the panels 70, 71, 72 and 73 over an extended period of time as desired by the user. Furthermore, because each panel 70, 71, 72 and 73 is an integral piece, minimal welding is required to assemble panels 70, 71, 72 and 73 to form storage body 62 unlike conventional storage bodies. In addition, the finished shape of storage body 62 is considerably aerodynamic thus occasioning less air resistance during travel of vehicle 50 advantageously resulting in less fuel consumption of vehicle 50 during normal refuse collection activities.

Each panel 70, 71, 72 and 73 may be desirably constructed from suitable sheet stock and rolled or formed to the desired arcuate shape in accordance with conventional manufacturing techniques well known to those having regard toward the relevant art. Furthermore, bottom panel 71 of storage body 62 is mounted and supported by frame 56 of vehicle 50. In accordance with conventional practice, bottom panel 71 may be fixedly engaged with frame 56 by virtue of suitable and conventional fastening mechanisms operative for fixedly and securingly engaging storage body 62 to frame 56.

With attention directed back to FIG. 1, vehicle 50 further includes a gate assembly generally designated by the reference character 90 including a closure element 91 mounted with downstream end 76 of storage body 62 to serve as a closure for downstream end 76 of storage body 62, in accordance with a preferred embodiment of the present invention. Motive or drive assemblies, each being generally designated by the reference character 92, operate to mount closure element 91 to downstream end 76 of storage body and to move closure element 91 between opened and closed positions, details of which will be discussed presently. For the purposes of orientation and reference, closure element 91 is generally intended to have an upper end 91A located adjacent top panel 70 of storage body 62 and a lower end 91B located toward rearward end 53 of chassis 51.

Figure 2:
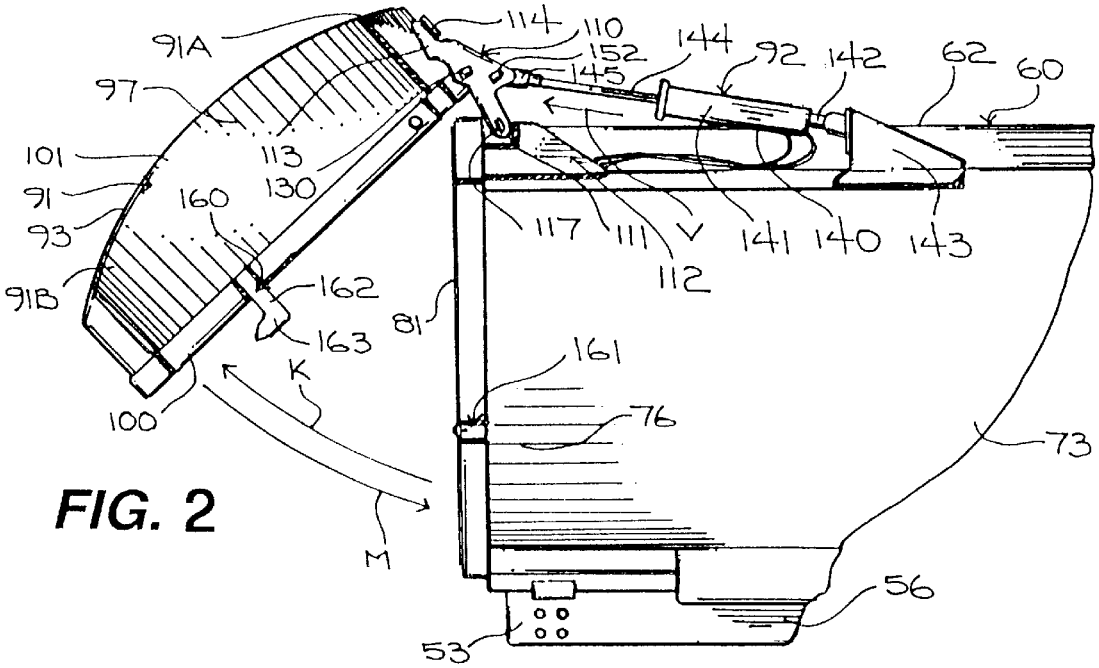
FIG. 2 is a side elevational view of the vehicle illustrated in FIG. 1, portions thereof broken away, with the closure element of the gate assembly shown as it would appear in an open position, in accordance with a preferred embodiment of the present invention.

With continuing reference to FIG. 2, closure element 91 is comprised of a generally cup-shaped body 93. Body 93, preferably constructed of steel or other material having similar structural and functional characteristics, includes an upper panel 94, a lower panel 95, side panels 96 and 97 and an end panel 98 cooperating together to define body 93. Like storage body 62, panels 94, 95, 96, 97 and 98 are outwardly arcuate and include edges that may be coupled together in a manner substantially similar to panels 70, 71, 72 and 73 of storage body 62 as previously discussed, further details of which will not be herein specifically described. For the purpose of orientation, body 93 is generally intended to have an inner end 100 and an outer end 101, with panels 94, 95, 96 and 97 including inner edges cooperating together to define inner end 100.

Because panels 70, 71, 72 and 73 of storage body 62 and panels 94, 95, 96, 97 and 98 of closure element 91 are integral pieces, they each may be desirably constructed from a single piece of sheet material. In the interests of eliminating waste, the sheet material may otherwise be desirably sized to the dimension of not only a single selected panel, but also provided of a size sufficient to allow a user to cut the sheet material for advantageously forming two or more panels of either storage body 62 and/or closure element 91.

Consistent with the preferred teachings of the instant invention, closure element 91 is movable between a normal closed position as shown in FIG. 1 and an open or refuse ejection position as shown in FIG. 2. In this regard, in the normal closed position of closure element 91, the inner edges defining inner end 100 of closure element 91 mate with and engage the rearward edges of panels 70, 71, 72 and 73 of storage body 62 to enclose the downstream opening. It is generally intended that during refuse collection operations, closure element 91 will be in the normal closed position for allowing refuse to be desirably transferred and stored from hopper 61 into the inner chamber of storage body 62. After collection is complete, the refuse is then transferred to a suitable refuse disposal facility at which time closure element 91 is moved from the normal closed position to the open position for allowing the refuse contained within the inner chamber of storage body 62 to be ejected through the downstream opening thereof, further details of which will be understood as the detailed description ensues.

As previously intimated in accordance with FIG. 2, closure element 91 is mounted with downstream end 76 of storage body 62 by virtue of motive or drive assemblies 92, each being operative and cooperating together to move closure element between the normal closed position and the open position. Each drive assembly 92 is the mirror image of the other. As shown in FIG. 1, drive assemblies 92 are mounted with storage body 62 at an elevated location proximate top panel 70 along the upper corners of storage body 62 in spaced-apart and substantially parallel relation. As it will be understood from the ensuing discussion, the preferred placement of each drive assembly 92 in the foregoing manner provides for the even distribution of the weight of closure element 91 by each drive assembly 92 for facilitating not only a secure and proper mount of closure element 91 to storage body 62, but also the efficient movement of closure element 91 by drive assemblies 92 alternately between the normal closed and open positions. Furthermore, although two drive assemblies 92 are illustrated in combination with a preferred embodiment of the present invention, it will be generally understood that one or more than two drive assemblies 92 may be used in combination with gate assembly 90 without departing from the nature and scope of the present invention as herein specifically described. In this regard, if a user were to choose to use one drive assembly 92, it may be desirably mounted at a location central of top panel 70 of storage body proximate the downstream end thereof.

Because each drive assembly 92 is the mirror image of the other, only one will be herein presented for ease and efficiency of discussion. Regarding a preferred embodiment thereof, drive assembly 92 is comprised of a linkage element 110 mounted for pivotal movement generally at downstream end 76 of storage body 62. Linkage element 110 is generally intended to include a proximal end 111 mounted for pivotal movement to an upstanding support flange 112 fixed to and extending upwardly from storage body 62 adjacent downstream end 76. Linkage element 110 extends rearwardly from proximal end 111 and is generally intended to terminate with a distal end 113 at a point outboard of the downstream opening of storage body 62, inboard of inner end 100 of closure element 91, somewhat subjacent proximal end 111 and subjacent and diametrically opposed to a stop 114 fixed to and extending laterally outwardly from upper end 91A of closure element 91. As herein specifically discussed, stop 114 is generally intended to be included within the nature and scope of drive assembly 92. Closure element 91 is mounted with and carried by linkage element 110 for pivotal movement at a point intermediate proximal end 111 and distal end 113.

A conventional hydraulic cylinder assembly 140 including a cylinder 141 having an inner end 142 mounted with storage body 62 inboard of or otherwise forwardly and spaced from the downstream opening and linkage element 110. In a further and more specific aspect, inner end 142 of cylinder 141 is mounted for pivotal movement to an upstanding flange 143 fixed to and extending upwardly from storage body 62 at a point forwardly of and spaced from flange 112. Hydraulic cylinder assembly 140 further includes an operating rod 144 mounted partially within cylinder 141 for reciprocal movement therein and terminating with an outer end 145 mounted with linkage element 110 for pivotal movement. Outer end 145 of operating rod 144 is interconnected for pivotal movement to a pair of support members by virtue of a pivot pin 152 extending through apertures in the support members and an aperture carried by outer end 145 of operating rod 144.

Having described the various structural details of drive assembly 92, prior discussions intimate that inner end 100 of closure element 91 operates to mate with the rearward edges of storage body 62 to enclose downstream opening 81 of storage body 61 in the normal closed position of closure element 91 as generally illustrated in FIG. 1. With closure element 91 supported by linkage element 110 of drive assembly 92 proximate upper end 91A thereof at pivot pin 130, an engagement means is provided to maintain closure element 91 in the normal closed position. To this end, and to desirably maintain closure element 91 in the normal closed position in accordance with a preferred embodiment of the present invention, provided is an engagement assembly 160 carried by closure element 91 proximate inner end 100 operative to detachably and securingly engage a complemental engagement assembly 161 carried by storage body 62 proximate downstream opening 81. Engagement assembly 160 is generally comprised of a pair of hook elements 162 (only one shown) carried by and extending outwardly from either lateral side of closure element 91 from each respective side panel 96 (hook element 162 not shown with respect to side panel 96) and 97 and terminating with a hooked distal end 163 at a point outboard of inner end 100, hooked distal end 163 further being directed downwardly toward frame 56 of chassis 51 in the closed position of closure element 91. Complemental engagement assembly 161 is generally comprised of a pair of corresponding pins carried by and extending outwardly from either lateral side of storage body 62 proximate downstream opening 81 thereof from each respective side panel 72 and 73 somewhat inboard of downstream opening 81. Consistent with the foregoing discussion, each hooked distal end 163 of each hook element 162 is operative for normally, hookingly and securingly receiving or otherwise engaging a respective pin in the normal closed position of closure element 91 in order to secure inner end 100 of closure element to the rearward edges of storage body 62 to enclose downstream opening 81 of storage body 62.

As linkage element 110 moves along ascending pivotal traverse as operating rod 144 is retracted into cylinder 141 from the normal closed position of closure element 91, linkage element 110 will pivot relative closure element about pivot pin 130 and distal end 113 of linkage element 110 will approach and subsequently engage stop 114 as illustrated in FIG. 2. Upon engagement of distal end 113 with stop 14, pivotal movement of closure element 91 about pivot pin 130 will cease to result in the vertical transverse of closure element 91 with linkage element 110. From this orientation of closure element 91 relative linkage element 110, the continued retraction of operating rod 144 into cylinder 141 will cause closure element 91 to pivot outwardly to disengage inner end 100 of closure element 91 from downstream opening 81 of storage body 62 and subsequently orient closure element 91 in the open position in the retracted orientation of operating rod 144 of hydraulic cylinder assembly 140 to correspondingly open and allow refuse ejection through downstream opening 81 of storage body 62.

From the foregoing discussion, it will be generally understood that engagement assembly 160 is engagable to and detachable from complemental engagement assembly 161 in response solely to the actuation of drive assembly 92. Engagement assembly 160 and complemental engagement assembly 161 contain no moving parts or parts requiring actuation to facilitate engagement and disengagement. In this regard, because engagement assembly 160 and complemental engagement assembly 161 are engagable to and detachable from one another solely in response to actuation of drive assembly 92 in the exemplary manner previously described, engagement assembly 160 and complemental engagement assembly constitute a passive engagement mechanism requiring no additional actuator mechanisms or manual latches.

Those having regard toward the relevant art will appreciate that gate assembly 90 sets forth an exemplary mechanism for facilitating the closing and opening of downstream opening 81 of storage body 62 in a vehicle 50 generally of the type operative for collecting refuse. Although not herein specifically set forth, conventional controls for operating hydraulic drive assembly 140 for each drive assembly 92 may be suitably located within cab 59 for allowing the operator to actuate gate assembly 90 alternately between the normal closed and opened positions of closure element 91 as desired. Also, although hydraulic drive assembly 140 has been disclosed as a preferred means of imparting alternating pivotal movement to linkage element 110 in the manner previously described, other suitable means for actuating linkage element 110 along alternating pivotal traverse may be employed consistent with the teachings herein without departing from the nature and scope of the present invention as herein specifically described. Furthermore, in the event one or more of the hydraulic cylinder assemblies 140 were to fail with closure element 91 in the open position, closure element 91 would merely fall from the open position to the closed position as herein described without incident.

Figure 3:
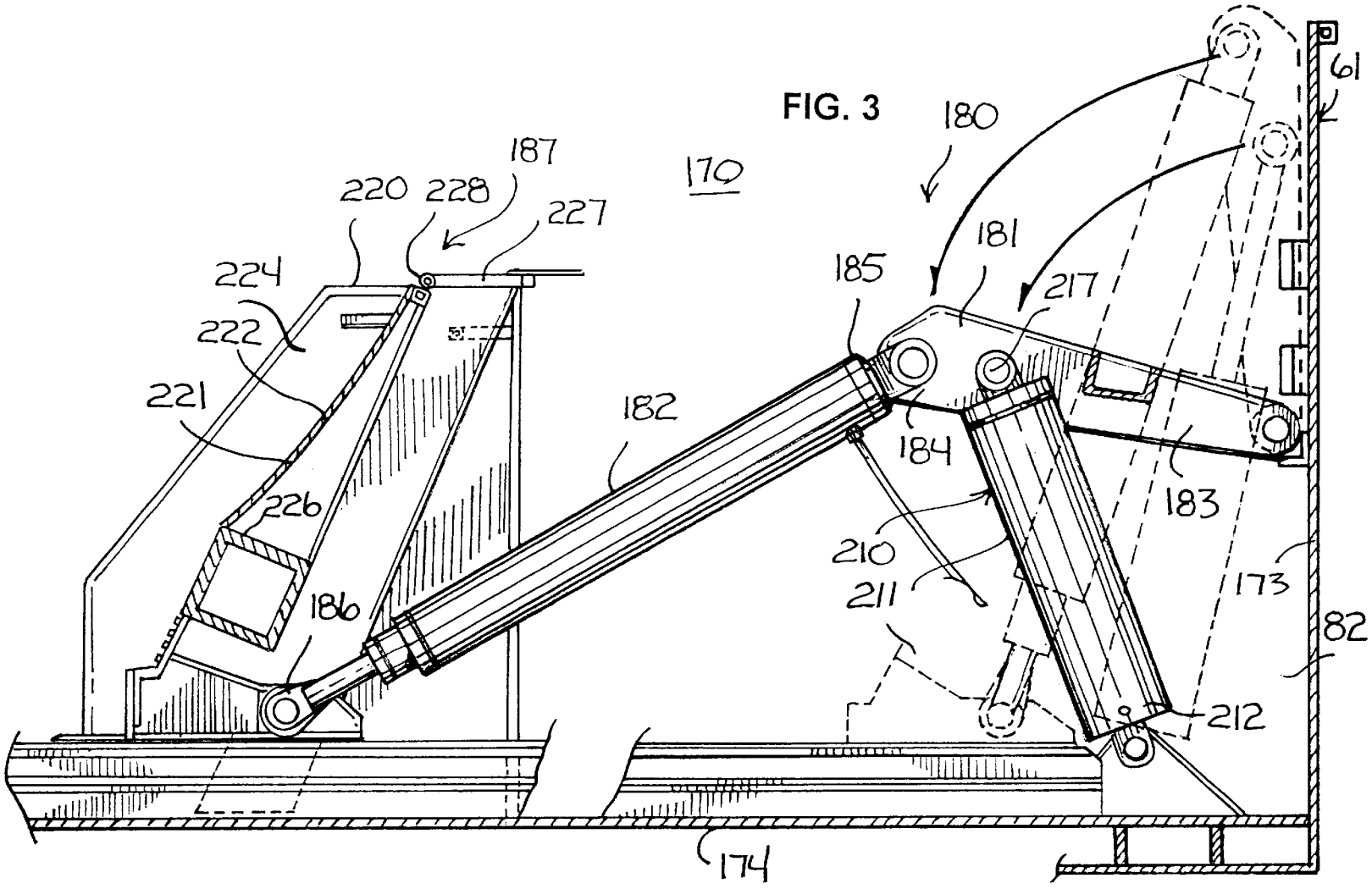
FIG. 3 illustrates a side elevational view of a packer and ejection assembly, in accordance with an embodiment of the present invention, the assembly is illustrated in a retracted mode in broken lines and in an extended or packing mode in full lines.

Referring specifically to FIG. 3, illustrated is a vertical curb side sectional view of hopper 61 and a portion of bottom panel 71 of storage body 62 further including a curb side elevational view of a packer and ejection assembly 170 in accordance with an embodiment of the present invention. Hopper 61 includes a floor or bottom panel 174 which is an extension of bottom panel 71 of storage body 62, floor 174 having a substantially arcuate shape like bottom panel 71 and extending forwardly from storage body 62 terminating with endwall 173. Packer and ejection assembly 170 includes a linkage assembly generally designated 180 including a linkage element 181 and an extendible element 182. Linkage element 181 has a proximal end 183 pivotally attached to hopper 61 at a location proximate upstream end 82 and in an elevated position relative to floor 174. Linkage element 181 extends outwardly from proximal end 183 to a distal end 184, which is pivotally attached to an inner end 185 of extendible element 182. Extendible element 182 extends rearwardly from distal end 184 of linkage element 181 and terminates with an outer end 186 pivotally attached to a platen 187. Platen 187 is mounted with hopper 61 and storage body 62 along a fixed path to serve as a means for facilitating the passage of platen 187 from hopper 61 into and through storage body 62 and the consequent transfer of refuse from hopper 61 into storage body 62 through the upstream opening of storage body 62 in response to the operation of linkage assembly 180, further details of which will be discussed as the detailed description ensues.

Figure 4:
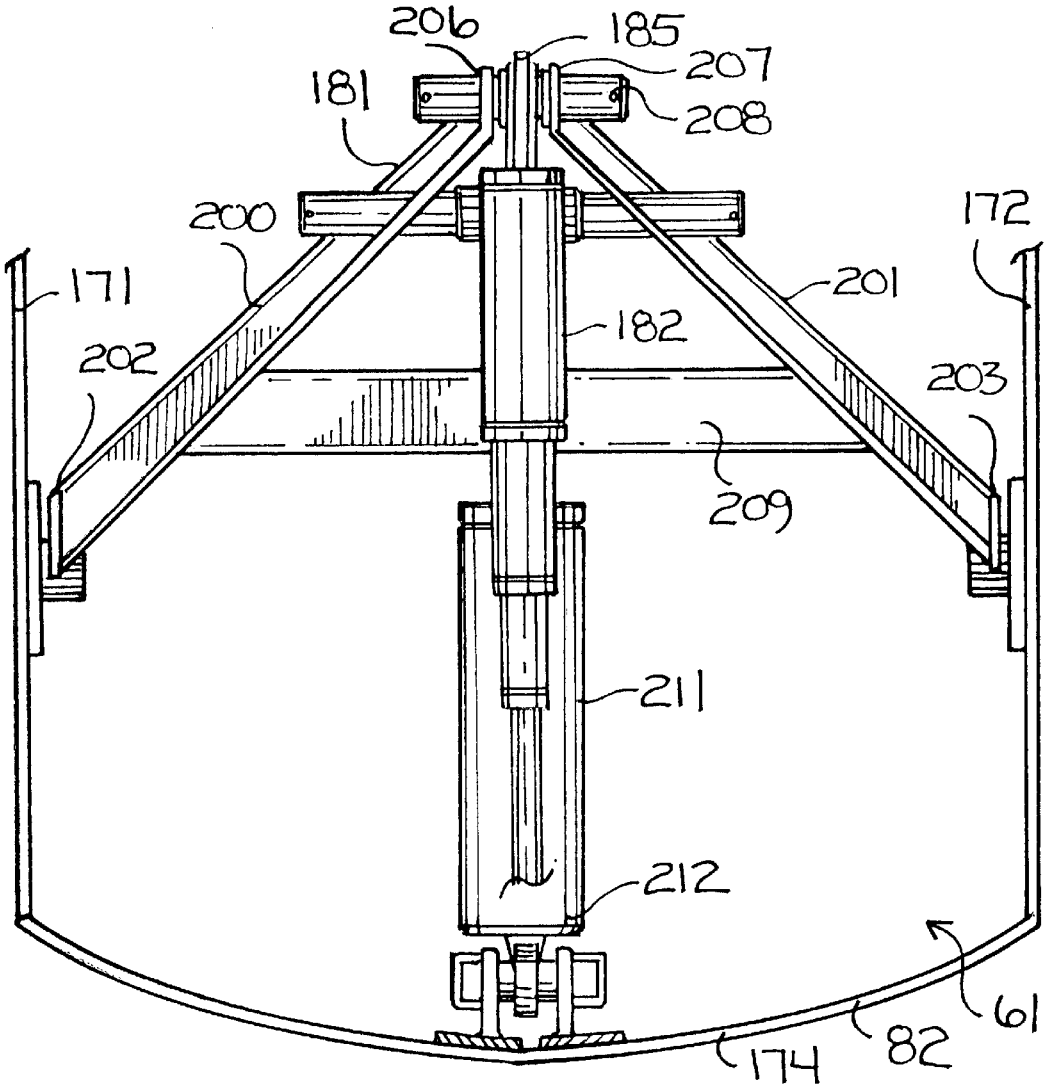
FIG. 4 illustrates a rear elevational view of the packer assembly of FIG. 3.

To further describe linkage element 181 in accordance with a preferred embodiment thereof, attention is directed to FIG. 4 illustrating a rear elevational view of linkage assembly 180. Linkage element 181 includes a pair of elongate arms 200 and 201 each having an inner end 202 and 203 pivotally affixed to a respective sidewall 171 and 172 of hopper 61 at an elevated location relative to floor 174 and proximate upstream end 82 of hopper 61. Inner ends 202 and 203 generally define proximal end 183 of linkage element 181 as previously discussed. Arms 200 and 201 extend inwardly into hopper 61 from inner ends 202 and 203 in converging relation and terminate with outer ends 206 and 207 generally defining distal end 184 of linkage element 181. Inner end 185 of extendible element 182 is mounted intermediate outer ends 206 and 207 for pivotal movement by a dowel 208 carried by outer ends 206 and 207. A substantially rigid transverse support element 209 interconnects arms 200 and 201 at a location generally intermediate inner ends 202 and 203 and outer ends 206 and 207 for imparting added strength to linkage element 181, although this is not an essential feature.

With continuing reference to FIG. 3, linkage assembly 180 articulates and is movable alternately between a retracted position (illustrated in broken lines) and an extended position (illustrated in full lines) operative for moving platen 187 alternately between a refuse receiving position located adjacent upstream end 82 of hopper 61 and a packing position located adjacent the upstream opening of storage body 62 for facilitating the transfer of refuse contained within hopper 61 rearwardly of platen 187 into storage body 62. In the retracted position of linkage assembly 180, linkage element 181 resides in a substantially upright or vertical orientation substantially parallel with endwall 173 of hopper 61 with extendible element 182 also residing in a substantially vertical orientation. From the retracted position, linkage assembly 180 may be moved along a forward stroke to the extended position, with linkage element 181 eventually resting in a substantially horizontal orientation. As linkage element 181 pivots from the substantially vertical orientation to the substantially horizontal orientation, extendible element 182 correspondingly pivots at inner end 185 to urge outer end 186 from the location adjacent upstream end 82 of hopper 61 along a substantially horizontal path prescribed by the fixed path of platen 187 to adjacent the upstream opening of storage body 62, with extendible element 182 eventually resting in a substantially horizontal orientation. From the retracted to the extended positions of linkage assembly 180 as herein described, platen 187, attached to outer end 186 of extendible element 182, correspondingly moves from the refuse receiving position adjacent upstream end 82 of hopper 61 to the packing position adjacent the upstream opening of storage body 62. The movement of platen 187 by linkage assembly 180 operates to bear platen 187 against refuse carried within hopper 61 rearward of platen 187 to facilitate the transfer of refuse from hopper 61 to the inner chamber of storage body 62.

From the extended position of linkage assembly 180, the foregoing operation for moving linkage assembly along the rearward stroke may be reversed for moving linkage assembly 180 along a return or forward stroke for correspondingly moving platen 187 from the packing position back to the refuse receiving position coincident with the retracted position of linkage assembly 180. In this manner of operation, linkage assembly 180 may be moved alternately along the rearward stroke and the forward stroke for allowing the repeated transferal of refuse from hopper 61 to storage body 62 during normal refuse collection operations.

A conventional hydraulic cylinder assembly 210 is provided to facilitate the desired actuation or movement of linkage assembly 180 alternately between the retracted and extended positions. Hydraulic cylinder assembly 210 includes a cylinder 211 having a lower end 212 pivotally attached to hopper 61 at a location somewhat rearwardly and subjacent to proximal end 183 of linkage element 181, forwardly of outer end 186 of extendible element 182 in the retracted orientation thereof and somewhat elevated from floor 174. Hydraulic cylinder assembly 210 further includes an operating rod 216 mounted partially within cylinder 211 for reciprocal movement therein and terminating with an upper end 217 pivotally attached to linkage element 181 at a location intermediate proximal end 183 and distal end 184 thereof. Upper end 217 of operating rod 216 is preferably attached to linkage element 181 at a location closer to distal end 184 rather than proximal end 183, although this is not an essential feature of the present invention. In this regard, upper end 217 of operating rod 216 may be mounted at any suitable location intermediate proximal end 183 and distal end 184, or perhaps mounted at distal end 184 if desired, without departing from the nature and scope of the present invention as herein specifically described.

In operation, hydraulic cylinder assembly 210 may be actuated between an extended orientation and a retracted orientation for moving linkage assembly 180 between the retracted and extended positions, respectively, along the forward and rearward stokes. In this regard, the extended orientation of hydraulic cylinder assembly 210 corresponds to the retracted position of linkage assembly 180 as indicated by the dotted outline of hydraulic cylinder assembly 210 and linkage assembly 180 in FIG. 3, and the retracted orientation of hydraulic cylinder assembly 210 corresponds to the extended position of linkage assembly 180. Therefore, from the extended orientation of hydraulic cylinder assembly 210 with operating rod 216 extended from cylinder 211, operating rod 216 will retract into cylinder 211 pulling linkage element 181 rearwardly along descending pivotal traverse. As operating rod 216 retracts into cylinder 211, upper end 217 will pivot relative linkage element 181 and upper end 217 will move along descending pivotal traverse coincident with distal end 183 of linkage element 181.

The foregoing physical characteristics of linkage assembly 180 and the actuation thereof by hydraulic cylinder assembly 210 between the retracted and extended orientations impart not only the desired movement of platen 187 between the retracted and extended positions as set forth for clearing hopper 61 of refuse and compacting it firmly into storage body 62, but also occasion unique operative functional characteristics throughout the stroke path along the forward stroke and the rearward stroke. In this regard, linkage assembly 180 desirably varies the packing force against platen 187 throughout the stroke path for increasing the packing force as platen 187 moves along the rearward stroke to the packing position of platen 187 and decreasing the packing force as platen 187 retracts along the forward stroke to the refuse receiving position of platen 187.

In particular, as hydraulic cylinder assembly 210 retracts from the extended orientation with linkage assembly 180 in the retracted position, the speed of platen 187 at the beginning of the rearward stroke will be relatively fast and the maximum packing force available by platen 187 against refuse will be relatively small. However, as hydraulic cylinder assembly 210 retracts and platen 187 moves rearward, platen 187 will move progressively slower increasing and maximizing the available packing force available by platen 187 against refuse as platen 187 progressively traverses along the rearward stroke. After considerable experimentation with the physical orientation of linkage assembly 180 and hydraulic cylinder assembly 210, a plot of the maximum or available packing force as a function of the extending position of platen 187 evinces a substantially hyperbolic curve which grows asymptotically to approach infinity as linkage assembly 180 approaches the extended position. Because the envelope of the maximum force required to accumulate refuse rearward of platen 187 and then to compress it into the accumulation of previously compacted refuse carried within the inner chamber of storage body 62 plotted as a function of the movement of platen 187 along the rearward or compacting stroke is a similarly shaped curve, the physical configuration of linkage assembly 180 and hydraulic drive assembly 210 impart a distribution of maximum packing force which exceeds the force required to compact or otherwise accumulate refuse within the inner chamber of storage body 62. Accordingly, rather than provide maximum packing force at every location of platen 187 along the rearward stroke, less hydraulic fluid may be delivered to cylinder 211 to achieve a given length of travel of platen 187 along the rearward stroke to achieve the maximum packing force by platen 187 against the refuse. As a consequence, the movement of platen 187 along the rearward stroke and the forward stroke is highly efficient and comparatively fast as compared to conventional packing assemblies currently in use. Due to the maximization of the packing force of platen 187 by linkage assembly 180, more refuse may be packed into storage body 62 for allowing the collection of greater loads of refuse.

With continuing reference to FIG. 3 illustrating platen 187 in vertical cross section, platen 187 is generally comprised of framework 220 including an upstanding panel 221 having a rearward surface 222 directed toward downstream opening 81 and a lower edge having a substantially arcuate shape operative to conform to the substantially arcuate shape of bottom panel 71 of storage body 62 and the arcuate shape of floor 174 of hopper 61. Platen 187 is preferably constructed of steel or other suitable material having similar structural and functional characteristics and further includes a pair of upstanding sidewalls (only sidewall 224 is visible in FIG. 3) mounted at either lateral side of panel 221 and a transverse support member 226 mounted with panel 221 interconnecting the pair of sidewalls. Support member 226 is tubular with a generally square cross section and operates to reinforce and add structural integrity to platen 187, although other suitable reinforcement mechanisms may be used for adding structural integrity to platen 187 if desired. Platen 187 further includes a shield 227 hingedly mounted to an upper edge 228 of panel 221 and operative to deflect refuse and inhibit refuse from falling in front of platen 187 onto linkage assembly 180 in the retracted position of platen 187 during normal refuse collection operations. The various structural features of platen 187 have been set forth for the purposes of orientation and reference and are not intended to be limiting in light of the nature and scope of the present invention as herein specifically described. In this regard, other suitable platen configurations may be used consistent with the foregoing and ensuing teachings if desired.

Turning now to the refuse ejection feature of packing and ejection apparatus 170, generally, once storage body 62 is filled with refuse it is time to transport the refuse to an appropriate dumping area and eject the refuse from storage body 62. To perform the refuse ejection feature, extendible element 182 of linkage assembly 180 is activated as described below. In the specific embodiment illustrated in FIGS. 3–5, extendible element 182 is a commercially available double acting, telescoping hydraulic apparatus with a main cylinder 301 and an additional telescoping cylinder 303 nested within cylinder 301, as illustrated best in FIG. 5. A rod 304 is nested within the smaller cylinder 303 and defines outer end 186 of extendible member 182. In this embodiment, extendible member 182 is simply a hydraulic cylinder that is extended normally by applying hydraulic fluid thereto, under the influence of which nested cylinder 303 and rod 304 are forced horizontally outwardly from cylinder 301 to extend or telescope extendible element 182 horizontally. In the preferred embodiment, extendible member 182 is constructed to extend sufficiently to move platen 187 along a stroke path generally to the rearward end of storage body 62.

For the purposes of orientation and reference, extendible member 182 is preferably constructed to have an extended length operative for accommodating the length of the stroke path without emerging outwardly from downstream opening 81 of storage body 62 upon movement of linkage assembly 180 into the extended orientation. In a further and more specific aspect, the preferred length of extendible member 182 is such that in the retracted orientation of linkage assembly 180 and extendible member 182, the forward end of platen 187 will desirably reside just rearwardly of lower end 212 of cylinder 211 as illustrated by the dotted outline of FIG. 5. Also, in the extended orientation of linkage assembly 180 and extendible element 182, the rearward end of platen 187 will reside proximate the rearward edge of bottom panel 71 of storage body 62 adjacent downstream opening 81 of storage body 62 without emerging outwardly from downstream opening 81 of storage body 62. Here it will be understood by those skilled in the art that extendible element 182 may be constructed with a length which will be sufficient to eject refuse through downstream opening 81 in a single cycle with linkage assembly 180 in the extended position, if desired. Further, in the actual ejection process, either extendible element 182 can be used alone (if sufficiently strong) or the refuse can be ejected in steps by extending extendible element 182 a short distance while linkage assembly 180 is retracted and then cycling hydraulic cylinder assembly 210 through a complete cycle, after which extendible element 182 is again extended a short distance. In this fashion the refuse is gradually stepped downstream toward opening 81.

Thus, linkage assembly 180 serves to receive and pack refuse into storage body 62 until such time as ejection is desirable (e.g. a fully loaded storage body 62). At that time closure element 91 is moved to the open position and extendible element 182 is actuated or extended horizontally, in conjunction with actuation of hydraulic drive assembly 210 of linkage assembly 180, to move platen 187 the length of storage body 62 and eject refuse from storage body 62 out through downstream opening 81. Extendible element 182 is then actuated to move or retract nested cylinder 303 and rod 304 from the extended position back to a stored position.

Figure 5:
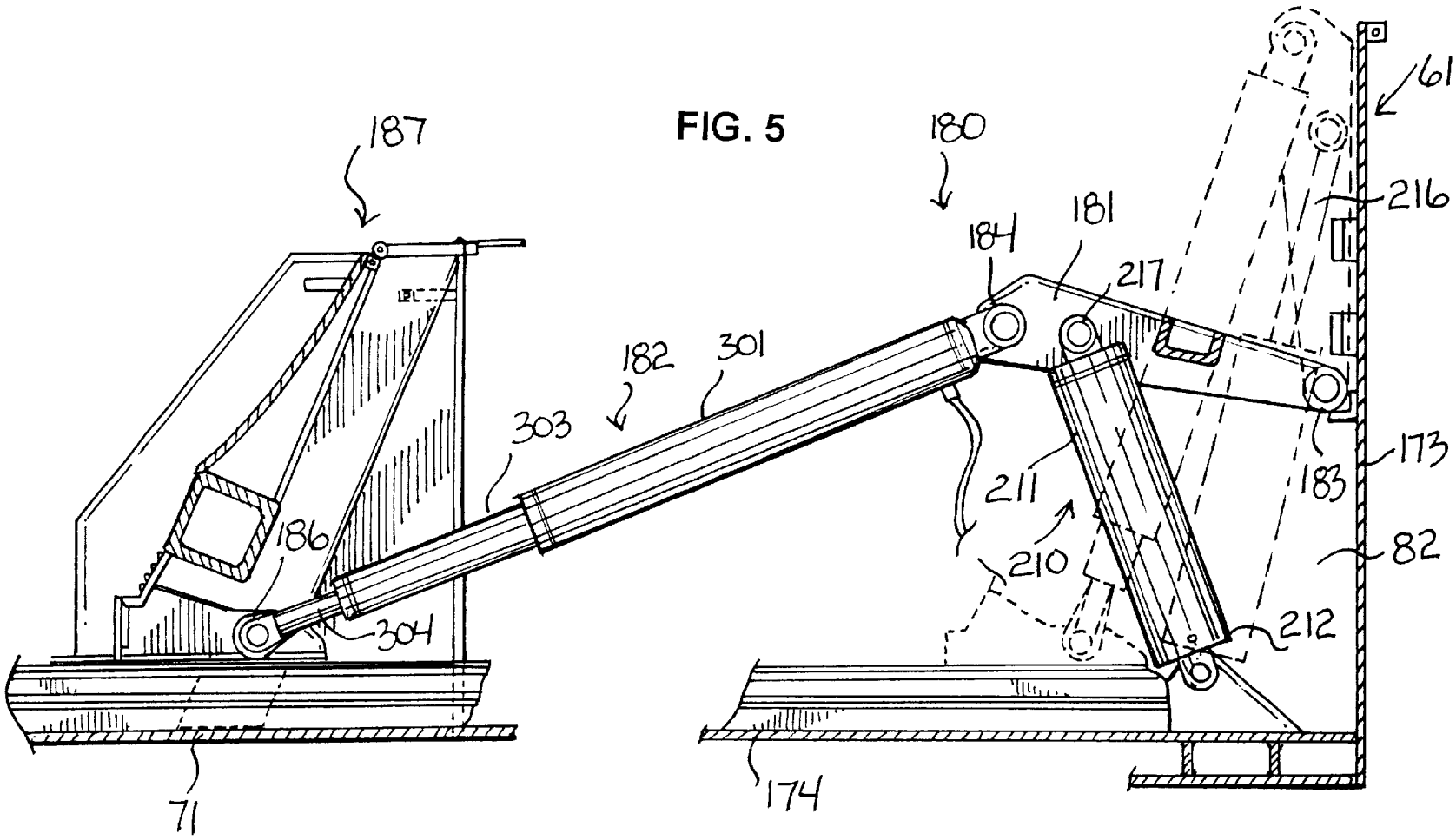
FIG. 5 illustrates a side elevational view of the packer and ejection assembly of FIG. 3, the packer and ejection assembly is illustrated in a retracted mode in broken lines and in a partially extended or ejecting mode in full lines.
Figure 6:
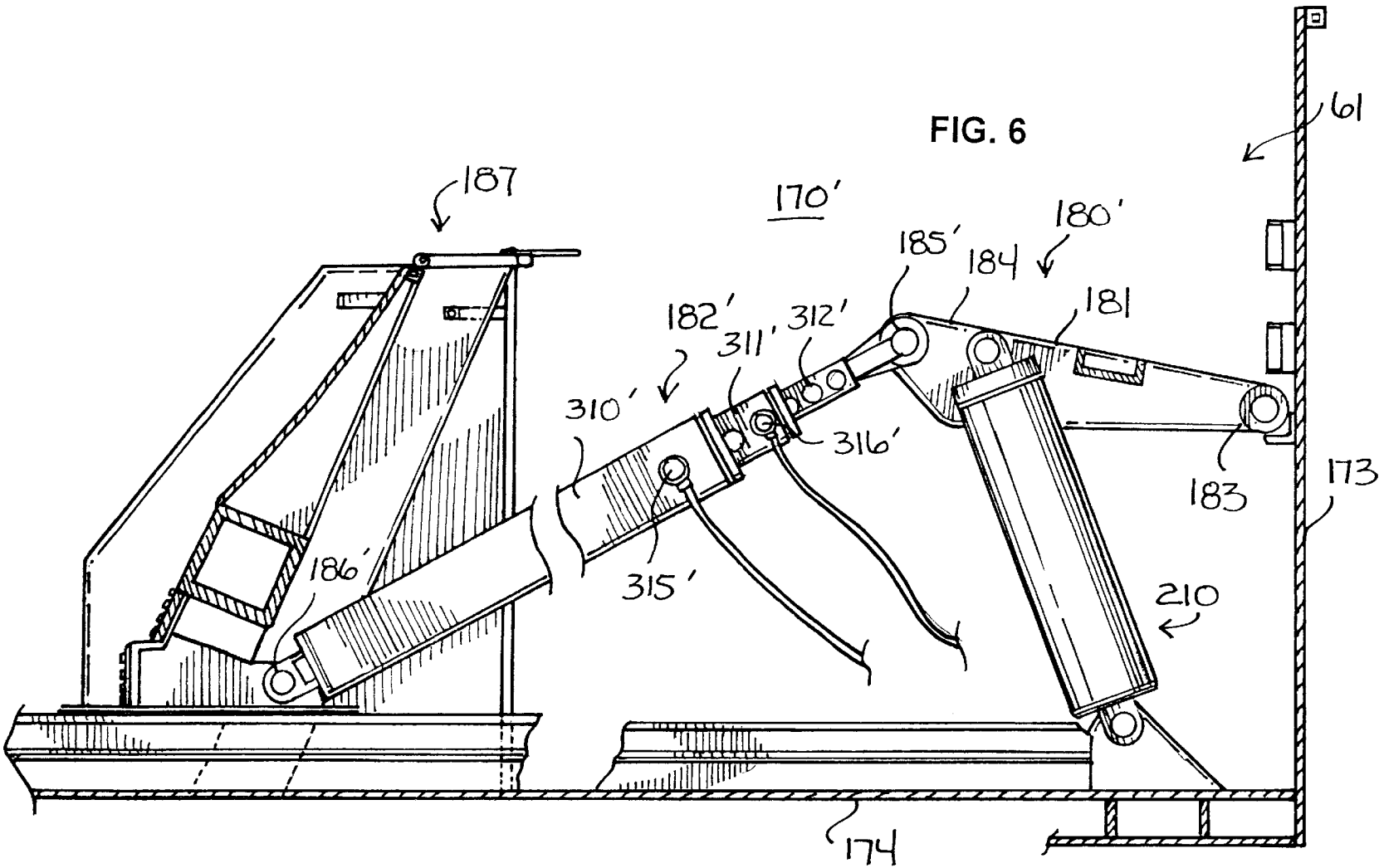
FIG. 6 illustrates a side elevational view of another packer and ejection assembly carried by the hopper of the vehicle of FIG. 1, in accordance with another embodiment of the present invention.
Figure 7:
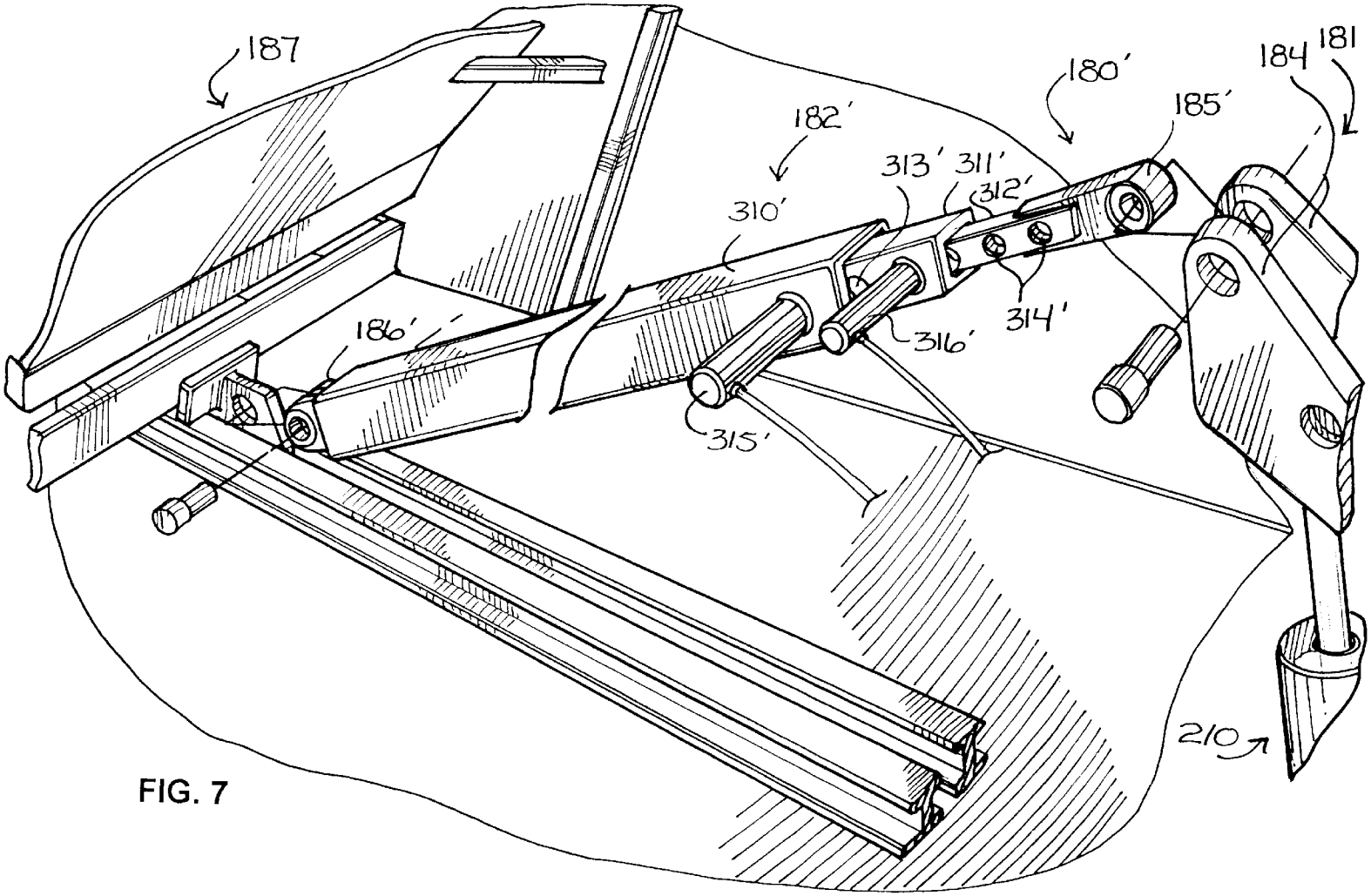
FIG. 7 illustrates an isometric exploded view of a portion of the packer and ejection assembly of FIG. 6, portions thereof broken away and shown in section.
Figure 8:
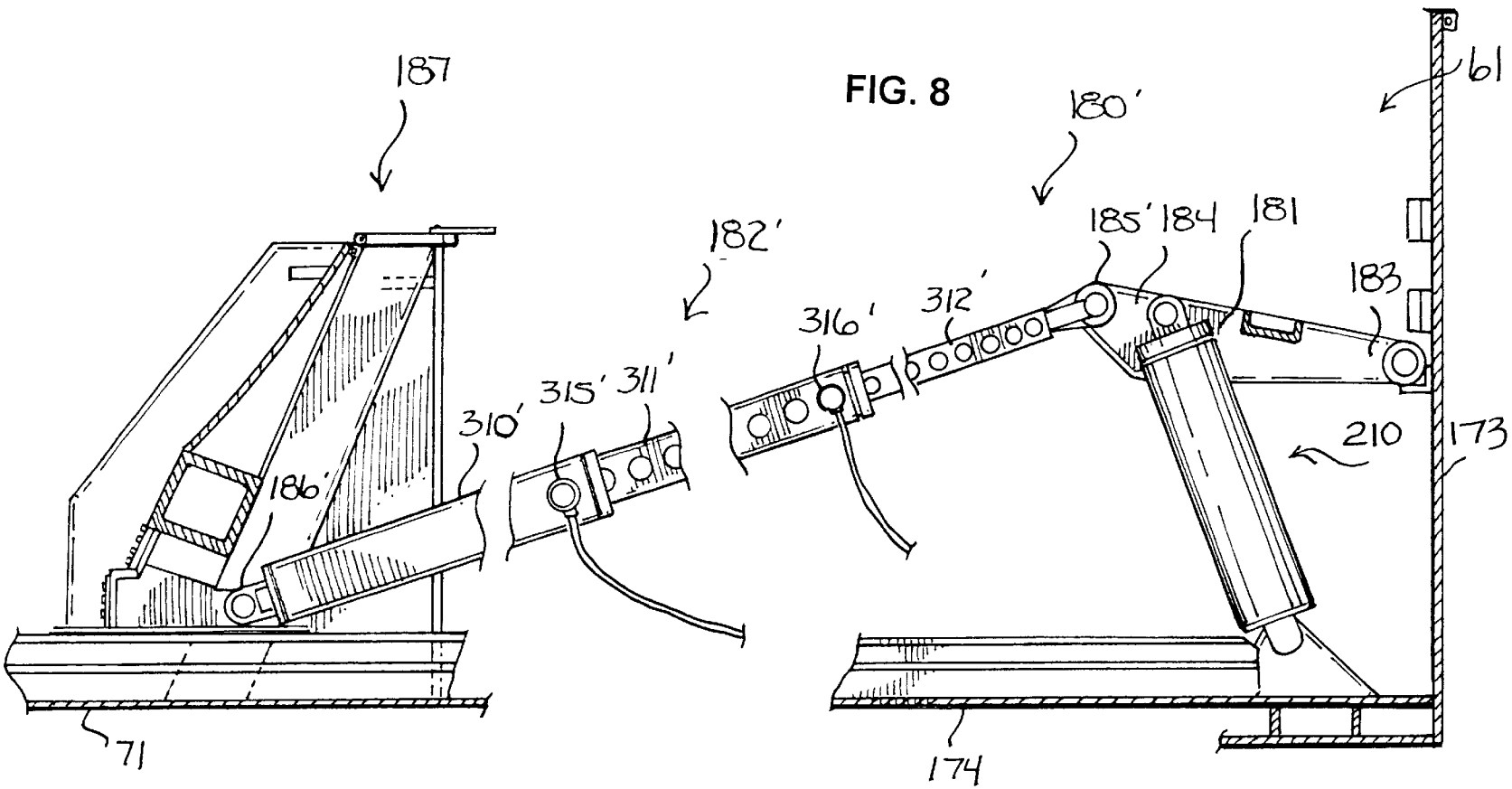
FIG. 8 illustrates a side elevational view of the packer and ejection assembly of FIG. 6 in an extended or ejection mode.

Turning now to FIGS. 6–8, another embodiment of packing and ejection apparatus, designated 170', is illustrated. In this embodiment components similar to the embodiment described in conjunction with FIGS. 3–5 are designated with similar numbers for convenience in understanding and new components are designated with a primed number to more readily indicate the different components. Referring specifically to FIGS. 6 and 7, an extendible element 182' is illustrated as a component of the linkage assembly 180'. In this embodiment, extendible element 182' is a telescoping set of nested cylinders or tubes 310', 311', and 312', with a rearward end of outer cylinder 310' pivotally attached to platen 187 and defining outer end 186'. In this preferred embodiment, cylinders 310', 311', and 312 are constructed with a generally square cross-section for convenience in aligning openings therein but it will be understood that a large variety of cross-sections (e.g. triangular, semi-circular, oval, etc.) could be used, all of which come within the definition of 'cylinder' or 'cylindrical', and they will still fulfill the functions of the present invention. Cylinder 311' is nested within outer cylinder 310' and cylinder 312', which is basically a solid rod-like element, is nested within cylinder 311' with an outwardly extending end thereof being pivotally attached to linkage element 181 and defining inner end 185'.

Cylinders 311' and 312' each have longitudinally spaced apart, horizontal openings 313' and 314', respectively, extending therethrough. A remotely actuatable stop element 315' is mounted on outer cylinder 310' adjacent the open end (opposite outer end 186'). Stop element 315' includes an outer housing and an inner bolt (not visible) which is movable upon actuation of stop element 315' between a position within the housing and an extended position outside the housing. Stop element 315' is mounted for horizontal movement of the inner bolt so that it will move into an aligned opening 313' and stop relative movement of cylinder 311' within outer cylinder 310'. Similarly, a remotely actuatable stop element 316' is mounted on cylinder 311' adjacent the open end (opposite the nested end). Stop element 316' includes an outer housing and an inner bolt (not visible) which is movable upon actuation of stop element 316' between a position within the housing and an extended position outside the housing. Stop element 316' is mounted for horizontal movement of the inner bolt so that it will move into an aligned opening 314' and stop relative movement of cylinder 312' within cylinder 311'. Stop elements 315' and 316' may be, for example, hydraulic cylinders, pressurized air cylinder, or electrically operated elements (solenoids), etc.

During refuse collection and storage (packing) operations, cylinders 310', 311' and 312' are nested and the inner bolts of stop elements 315' and 316' are engaged in an appropriate opening 313' and 314', respectively, generally as illustrated in either FIG. 6 or 7. Hydraulic drive assembly 210 is actuated to produce movement of platen 187 in reciprocal directions, i.e. the retracted orientation and the extended orientation. Movement of linkage assembly 180 to the retracted orientation will define a fully retracted orientation of platen 187 within hopper 61. In this fully retracted orientation of platen 187, refuse may properly be collected and placed within hopper 61 rearwardly of platen 187 adjacent rearward surface 222 of panel 221. Once collected, a user may then actuate linkage assembly 180 into the extended orientation for transferring and packing refuse from hopper 61 and into storage body 62 and then back to the retracted orientation for allowing refuse to be deposited into hopper 61 prior to initiating a succeeding forward stroke. During the packing operations extendible element 182' is maintained at a fixed length, generally complete or nearly complete nested orientation.

Thus, linkage assembly 180 serves to receive and pack refuse into storage body 62 until such time as ejection is desirable (e.g. a fully loaded storage body 62). At that time closure element 91 is moved to the open position and extendible element 182' is actuated by operating stop element 315' and then stop element 316' to extend extendible element 182' horizontally (generally illustrated in FIG. 8), in conjunction with actuation of hydraulic drive assembly 210 of linkage assembly 180, to move platen 187 the length of storage body 62 and eject refuse from storage body 62 out through downstream opening 81. Extendible element 182 is then actuated to move or retract nested cylinders 310', 311' and 312' from the extended position back to a nested or stored position.

In a step-by-step description of the extension operation of extendible member 182', hydraulic drive assembly 210 is actuated to move linkage assembly 180 into the extended position. The inner bolt of stop element 315' is then withdrawn from aligned opening 313' and hydraulic drive assembly 210 is actuated to move linkage assembly 180 into the retracted position. The inner bolt of stop element 315' is then extended to engage a second aligned opening 313' rearward of the initial aligned opening 313'. The extension and retraction steps of linkage assembly 180 are repeated with the inner bolt of stop element 315' being moved to successively farther rearwardly positioned openings 313'. When cylinder 311' is completely telescoped from outer cylinder 310', the procedure is repeated by engaging and disengaging the inner bolt of stop element 316'. In this fashion, extendible element 182' is completely extended, generally as illustrated in FIG. 8, to eject refuse from storage body 62. To move extendible element 182' back to a nested orientation, the above steps are simply reversed. Here it should be understood that stop 316' could be activated first and then stop 315', if desired. Also, while a three cylinder extendible element 182' is illustrated and described, it will be readily apparent to those skilled in the art that more or fewer cylinders can be incorporated.

In this manner, hydraulic drive assembly 210 and linkage assembly 180' may be employed for moving platen 187 incrementally along forward stroke movement of linkage assembly 180' from proximate upstream end 82 of hopper 61 to proximate downstream opening 81 of storage body 62 for facilitating the ejection of refuse outwardly through downstream opening 81 for allowing the efficient deposit of the refuse contained within storage body 62 at a suitable refuse disposal facility. The number of forward strokes and corresponding rearward strokes of linkage assembly 180 required to move platen 187 alternately between the upstream end of hopper 61 to downstream opening 81 of storage body 62 may vary depending upon the length of extendible member 182' and the number and spacing of openings 313' and 314', as well as the length of the storage body 62.

The present invention has been described above with reference to a preferred embodiment. However, those skilled in the art will recognize that changes and modifications may be made in the described embodiments without departing from the nature and scope of the present invention. Various changes and modifications to the embodiment herein chosen for purposes of illustration will readily occur to those skilled in the art. To the extent that such modifications and variations do not depart from the spirit of the invention, they are intended to be included within the scope thereof which is assessed only by a fair interpretation of the following claims.

Having fully described the invention in such clear and concise terms as to enable those skilled in the art to understand and practice the same, the invention claimed is:

1. For use with a vehicle of a type having a body mounted with a chassis, the body having an opening for receiving refuse therethrough, a packer and ejection assembly for moving and storing refuse in the body through the opening and ultimately ejecting the refuse from the body, the packer and ejection assembly comprising:

a platen mounted with the body to urge refuse into the body through the opening and ultimately eject the refuse from the body;

a linkage assembly including a linkage element having a first end and a second end and an extendible element having a first end and a second end, the first end of the linkage element being pivotally attached to the body, the second end of the linkage element being pivotally coupled to the first end of the extendable element, and the second end of the extendible element being pivotally attached to the platen; and a hydraulic drive assembly pivotally attached to the body and to the linkage element intermediate the first end and the second end thereof for movement in reciprocal directions upon actuation of the hydraulic drive assembly such that during movement of the platen through a rearward stroke the speed of the platen decreases and the force exerted by the platen on the refuse increases throughout the rearward stroke and during movement of the platen through a forward stroke the speed of the platen increases, the linkage assembly being movable in reciprocal directions for moving the platen in reciprocal directions.

2. The packer and ejection assembly of claim 1, wherein the hydraulic drive assembly comprises:

a cylinder having an end mounted with the body; and an operating rod mounted partially within the cylinder for movement in reciprocal directions, the linkage assembly movable in reciprocal directions upon actuation of the operating rod in reciprocal directions.

3. The packer and ejection assembly of claim 2, wherein the end of the operating rod is mounted with the linkage element intermediate the first end thereof and the point of pivotal attachment of the linkage element with the extendible element.

4. The packer and ejection assembly of claim 1, wherein the linkage element includes a pair of elongate arms each having an end pivotally mounted with the body for pivotal movement and cooperating together to define the first end of the linkage element, the pair of elongate arms extending in converging relation to pivotally mount with the extendible element.

5. The packer and ejection assembly of claim 1, wherein the extendible element of the linkage assembly is actuatable to provide extension and retraction of the extendible element of the linkage assembly and produce movement of the platen through rearward ejection strokes and forward ejection strokes for ejecting refuse from the body.

6. The packer and ejection assembly of claim 5, wherein the extendible element of the linkage assembly is constructed and attached so that during movement of the platen through the rearward ejection strokes the speed of the platen decreases and the force exerted by the platen on the refuse increases throughout the rearward ejection strokes and during movement of the platen through the forward ejection strokes the speed of the platen increases.

7. The packer and ejection assembly of claim 5, wherein the extendible element of the linkage assembly includes a telescoping element.

8. The packer and ejection assembly of claim 5, wherein the extendible element includes a hydraulic drive assembly.

9. The packer and ejection assembly of claim 8, wherein the hydraulic drive assembly includes a telescoping hydraulic cylinder.

10. The packer and ejection assembly of claim 8, wherein the hydraulic drive assembly includes a double acting telescoping hydraulic cylinder.

11. A vehicle for collecting refuse, comprising:

a chassis;

a body mounted with the chassis for receiving refuse through an opening thereof;

a packer and ejection assembly comprising:

a platen mounted with the body to urge refuse into the body through the opening;

a linkage assembly including a linkage element having a first end and a second end and an extendible element having a first end and a second end, the first end of the linkage element being pivotally attached to the body, the second end of the linkage element being pivotally coupled to the first end of the extendable element, and the second end of the extendible element being pivotally attached to the platen;

a hydraulic drive assembly pivotally attached to the body and to the linkage element spaced from the first end thereof for movement in reciprocal directions upon actuation of the hydraulic drive assembly such that during movement of the platen through a rearward stroke the speed of the platen decreases and the force exerted by the platen on the refuse increases throughout the rearward stroke and during movement of the platen through a forward stroke the speed of the platen increases, the linkage assembly being movable in reciprocal directions for moving the platen in reciprocal directions; and the hydraulic drive assembly cooperating with the linkage assembly so that activation of the hydraulic drive assembly produces reciprocal packing movements and the extendible element being constructed to provide ejection of refuse from the body upon extension thereof.

12. The packer and ejection assembly of claim 11, wherein the extendible element includes means for extending the extendible element between an extended and a stored position.

13. The packer and ejection assembly of claim 12, wherein the extendible element includes a telescoping element.

14. The packer and ejection assembly of claim 12, wherein the extendible element includes a hydraulic drive assembly.

15. The packer and ejection assembly of claim 14, wherein the hydraulic drive assembly includes a telescoping hydraulic cylinder.

16. The packer and ejection assembly of claim 14, wherein the hydraulic drive assembly includes a double acting telescoping hydraulic cylinder.

* * * * *